US007506417B2

(12) United States Patent
Yoneoka

(10) Patent No.: US 7,506,417 B2
(45) Date of Patent: Mar. 24, 2009

(54) SLIDER FOR A SLIDE FASTENER AND A SLIDE FASTENER

(75) Inventor: Morimasa Yoneoka, Prarolo (IT)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/500,684

(22) Filed: Aug. 8, 2006

(65) Prior Publication Data

US 2007/0033776 A1 Feb. 15, 2007

(30) Foreign Application Priority Data

Aug. 10, 2005 (GB) ..... 0516442.1

(51) Int. Cl.
*A44B 19/26* (2006.01)

(52) U.S. Cl. ..... 24/430; 24/386; 24/415

(58) Field of Classification Search ..... 24/429, 24/386, 385, 382, 430, 387; 70/68, 312, 70/315; 292/318, 307 R
See application file for complete search history.

(56) References Cited

U.S. PATENT DOCUMENTS 2,398,947 A * 4/1946 Davis ..... 24/386
4,081,882 A * 4/1978 Toepelt et al. ..... 24/386
4,123,829 A * 11/1978 Takabatake ..... 24/386
4,512,599 A * 4/1985 De Lima Castro Netto ..... 292/307 R
5,031,944 A * 7/1991 Keyaki ..... 292/307 R
5,103,657 A * 4/1992 Horita et al. ..... 70/68
5,253,395 A * 10/1993 Yano ..... 24/387
6,062,051 A * 5/2000 Nam et al. ..... 70/68
6,510,593 B1 * 1/2003 Kim ..... 24/418

FOREIGN PATENT DOCUMENTS

EP 1300094 A1 4/2003

* cited by examiner

*Primary Examiner*—Robert J Sandy
(74) *Attorney, Agent, or Firm*—Alston & Bird LLP

(57) ABSTRACT

A slider 1 for a slide fastener 95 comprises a slider body 3 which is slidable over elements of a slide fastener 95 to engage and disengage the elements, and a latch body 5, removably mounted on the slider body 3. The latch body 5 comprises latching means 47, 55 for latching the slider 1 to a cooperating slider. A deflectable tongue 77 on the latch body 5 abuts a projection 69 on the slider body 3 to prevent separation of the latch body 5 from the slider body 3 when the tongue 77 is at rest. When the tongue 77 is deflected away from the projection 69, the latch body 5 and the slider body 3 can be separated.

9 Claims, 6 Drawing Sheets

SLIDER FOR A SLIDE FASTENER AND A SLIDE FASTENER

CROSS-REFERENCE TO RELATED APPLICATIONS

The entire disclosure of British patent application number 0516442.1 filed on Aug. 10, 2005 is incorporated herein by reference in its entirety.

BACKGROUND

1. Field of the Invention

This invention relates to a slider for a slide fastener. In particular it relates to a lockable slider that can be attached to a second cooperating slider.

2. Description of the Related Art

Slide fastener sliders of the above type are well known in general. However, there is a tendency for the sliders to separate accidentally, allowing unintentional opening of the slide fastener. In order to overcome this problem, different lockable sliders have been suggested.

In EP-A-1300094 there is described a slide fastener having two sliders arranged to be slidable on a pair of interlocking stringers so as to open the fastener when separated and close the fastener when brought together. One of the sliders comprises a receiving portion and the other slider comprises a cooperating latching portion which is engagable with the receiving portion. The sliders engage and are separated by elastic deformation of the receiving and/or the latching portions as they are pushed together and pulled apart. The slider has a body portion which is formed separately from the receiving or latching portion, so that different materials may be used.

A feature of the slider described in the EP-A-1300094 is that during the latching and unlatching of two sliders, the receiving and/or the latching portion is deformed, causing wear and tear to these parts, which may lead to their failure to latch together or to their breakage.

Furthermore, during latching and, in particular, during unlatching of these sliders, a large force is exerted on the puller, which can cause a puller or the crown/bridge of a slider to which the puller is attached, to break. In general, the stronger the connection between latching sliders, the greater the force required to latch and unlatch the sliders. Hence, the likelihood of a puller or crown breaking is greater than for non-latching sliders. It is preferable to design the puller to break before the crown when excessive force is applied, and in such circumstances it is important to be able to replace a broken puller of a latching slider.

Therefore, the body portion comprising the receiving and/or the latching portion is removable, by lifting the crown/bridge of the slider body and by pulling the removable body portion from the slider body.

A problem with this arrangement is that it is difficult to remove the removable body portion from the slider body, as it is difficult to lift the crown of the slider body. This is because the slider body is conventionally made of metal or a rigid plastic, so as to withstand the wear and tear of being repeatedly moved along the elements of the slide fastener. Therefore, a large force is required to lift the crown, which makes removal of the removable body portion from the slider body awkward and which may cause breakage or permanent deformation of the crown.

Therefore, an object of this invention is to provide a slider having a readily removable body portion to enable effortless replacement of the puller or the removable body portion, the removable body portion being firmly mounted on the slider body during normal use.

SUMMARY

According to a first aspect of the invention there is provided a slider for a slide fastener, the slider comprising: a slider body which is slidable over elements of a slide fastener to engage and disengage the elements; and a latch body removably mounted on the slider body, the latch body comprising latching means for latching the slider to a cooperating slider, wherein the latch body and the slider body comprise respective first and second cooperating locking means, the locking means preventing separation of the latch body from the slider body when the locking means are at rest, the first locking means being resiliently movable to allow separation of the latch body from the slider body.

Preferably the locking means comprise abutting faces, wherein the first locking means is movable to allow the abutting faces to pass each other.

Preferably the abutting face of the first locking means is a face of a resiliently deflectable tongue.

Preferably the tongue has a sloping face 87 on which the second locking means bears to deflect the tongue as the latch body is mounted on the slider body.

Preferably the second locking means comprises a sloping face on which the first locking means slides to deflect the tongue as the latch body is mounted on the slider body.

Preferably the slider body comprises a crown for a puller attached at one end to the slider body. The crown has its base joined to the slider body and has its free end define a gap with the slider body. The second locking means is disposed on the free end of the crown.

Preferably the crown is attached to the slider body above a guide post of the slider body which partly defines an element-running path.

Preferably the latching means comprises a first receiving portion on a second slider and a first latching member for latching with the first receiving portion. At least one of the first latching member or the first receiving portion is resiliently deformable.

Preferably the latching means further comprises a second latching member on the second slider and a second receiving portion for receiving the second latching member. At least one of the second latching member or the second receiving portion is resiliently deformable.

According to a second aspect of the invention there is provided a slide fastener comprising: a first slider and a second slider arranged to be slidable on a pair of interlocking stringers so as to open the slide fastener when separated and close the slide fastener when brought together, each slider comprising a slider body which is slidable over elements of the slide fastener to engage and disengage the elements, and a latch body removably mounted on the slider body, the latch body comprising latching means for latching the slider to the other slider, wherein the latch body and the slider body comprise respective first and second cooperating locking means, the locking means preventing separation of the latch body from the slider body when the locking means are at rest, the first locking means being resiliently movable to allow separation of the latch body from the slider body.

Preferably the slide fastener further comprises a first receiving portion disposed on the latch body of the first slider; a first latching member disposed on the latch body of the second slider and engageable with the first receiving portion; a second receiving portion disposed on the latch body of one of the sliders; and a second latching member disposed on the latch body of the other of the sliders and engageable with the second receiving portion; wherein the first and second receiving portions are arranged to engage with the first and second latching members respectively, to releasably latch the first and second sliders together, and the latching members and receiving portions are arranged to be disengaged by movement of the latching members away from each other, so unlatching the sliders.

According to a third aspect of the invention there is provided a slider for a slide fastener, the slider comprising: a slider body which is slidable over elements of a slide fastener to engage and disengage the elements; and a removable body portion removably mounted on the slider body, wherein the removable body portion and the slider body comprise respective first and second cooperating locking means, the locking means preventing separation of the removable body portion from the slider body when the locking means are at rest, the first locking means being resiliently movable to allow separation of the removable body portion from the slider body.

DESCRIPTION OF THE DRAWINGS

An embodiment of the invention will now be described by way of example, with reference to the accompanying drawings in which.

Figure 1:
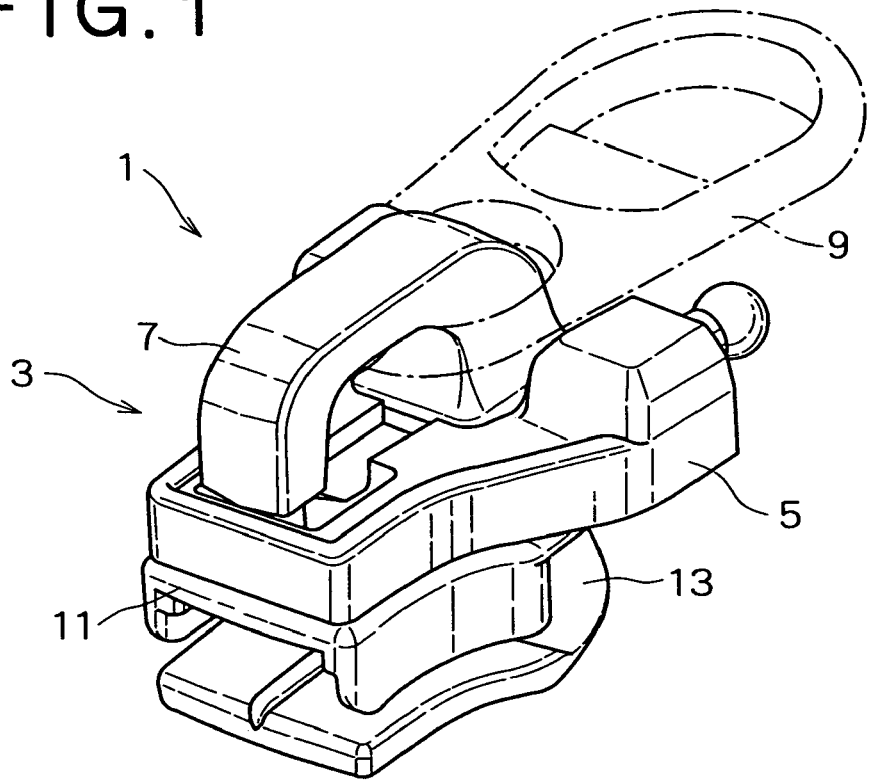
FIG. 1 is a perspective view of a slider in accordance with the invention.

The following provides a list of the reference characters used in the drawings:

| | |
|---|---|
| 1 | Slider |
| 3 | Slider body |
| 5 | Latch body |
| 7 | Crown |
| 9 | Puller |
| 11 | Upper blade |
| 13 | Lower blade |
| 15 | Guide post |
| 17 | Front end |
| 19 | Rear end |
| 21 | Retaining flange |
| 23 | Outer edge |
| 25 | Upper surface |
| 27 | Free end |
| 29 | Gap |
| 33 | Ridge |
| 35 | Central region |
| 37 | Base |
| 39 | Front end |
| 41 | Arm |
| 43 | Arm |
| 45 | Gap |
| 47 | Protrusion |
| 49 | End face |
| 51 | Neck portion |

-continued

| | |
|---|---|
| 53 | Head |
| 55 | Mouth |
| 57 | End face |
| 59 | Neck portion |
| 61 | Opening |
| 63 | Ridge |
| 65 | Hollow |
| 67 | End face |
| 69 | Sloping projection |
| 71 | Sloping face |
| 73 | C-shaped aperture |
| 75 | Rear end portion |
| 77 | Tongue |
| 79 | Rear end |
| 81 | Ramp |
| 85 | Upper surface |
| 89 | Central portion |
| 91 | Abutting face |
| 93 | Abutting face |
| 95 | Slide fastener |

DETAILED DESCRIPTION

FIG. 1 shows a slider 1 in accordance with the invention. The slider 1 is comprised of a slider body 3 and a latch body 5. The latch body 5 is removably mounted on the slider body 3. A crown 7 projects from an upper blade 11 of the slider body 3 and extends longitudinally of the slider body 3, as described below with reference to FIGS. 2 and 3. The crown 7 provides an attachment point for a puller 9, as is well known in the art, as well as holding the latch body 5 in place. The latch body 5 has a function to hold the two sliders joined to each other, and can be operated so as to take a joined disposition in which a pair of sliders 1 mounted on a slide fastener are close to each other and a separated disposition in which they are away from each other.

Figure 2:
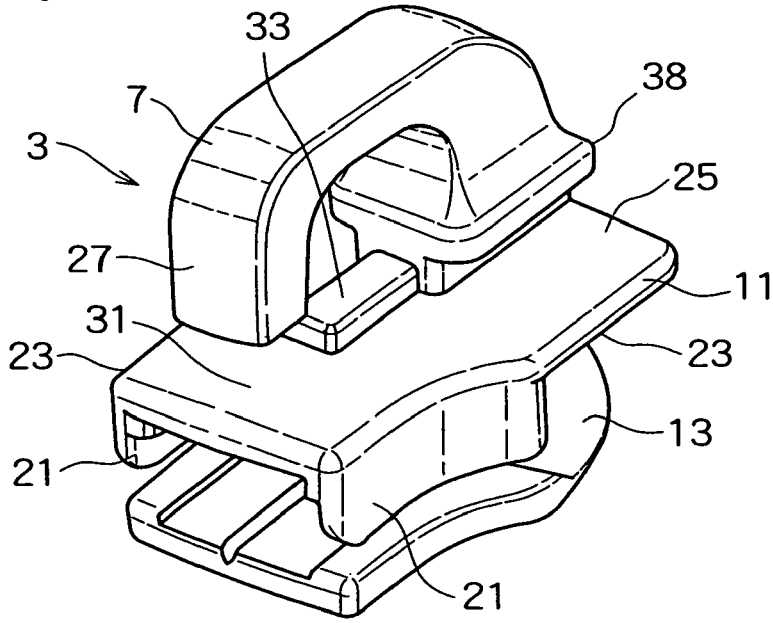
FIG. 2 is a perspective view of a slider body of the slider of FIG. 1.
Figure 3:
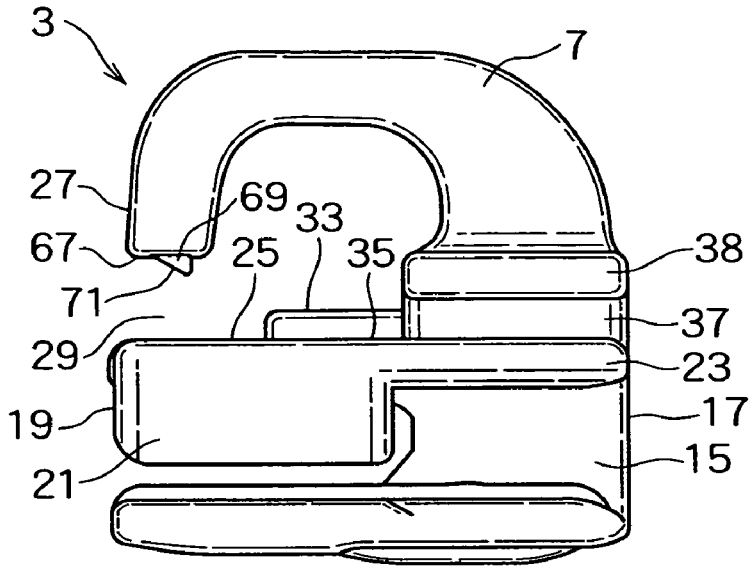
FIG. 3 is a side view of the slider body of FIG. 2.

FIG. 2 is a perspective view of the slider body 3, which is shown in side view in FIG. 3. The slider body 3 is either made of metal or of plastic (e.g., Polybutylene terephthalate). If made of metal, it may be formed by die casting and if made of plastic it may be injection moulded.

The slider body 3 is comprised of the upper blade 11 and a lower blade 13 arranged in parallel spaced relation, which are joined by a guide post 15 at the front end 17 of the slider body 3. The upper blade 11 and the lower blade 13 define therebetween a gap through which fastener elements run. Towards the rear end 19 of the slider body 3, retaining flanges 21 extend from the lateral outer edges 23 of the upper blade 11 in the direction of the lower blade 13. The upper surface 25 of the upper blade 11 is comprised of a front region, a central region 35 and a rear region arranged in sequence from the front end to the rear end. The crown 7 projects from the upper surface 25 of the upper blade 11 at the front end 17 of the slider body 3, that is, above the guide post 15. The crown 7 has its base 37 integrally joined to the upper surface 25 and is arched so that the free end 27 points towards the rear region 31 of the upper surface 25 of the upper blade 11. There is a gap 29 between the free end 27 of the crown 7 and the upper blade 11 of the slider body 3, to accommodate the latch body 5 in the assembled slider 1, as described below. The guide post 15 and the retaining flanges 21 define therebetween within the slider body 3 a Y-shaped path through which fastener elements run, so that the fastener elements are guided by the guide post 15 and the retaining flanges 21 so as to move in the directions to be coupled and decoupled.

A pair of engaging recesses are formed one on each longitudinal side of the base 37 of the crown 7. The base 37 has a pair of cantilevered portions 38 formed one on each lateral side thereof at its upper end, to thus present a T-shaped cross-section. The recesses are partly defined between the lower surface of the cantilevered portion 38 and the upper surface of the upper blade 11.

A pair of engaging ledges 46 are formed on the respective inner opposed sides of the arms 41, 43 of the latch body 5 so as to project into the gap 45 and extend longitudinally of the latch body 5. When the latch body 5 is joined to the slider body 3, the engaging ledges 46 come into engagement with the respective engaging recesses, and the cantilevered portions 38 come into overlaying engagement with the engaging ledges 46. This prevents the latch body 5 from moving upwards of the slider body 3.

The end face 67 of the free end 27 of the crown 7 is generally parallel to the upper surface 25 of the upper blade 11. There is sloping projection 69 on the end face 67. The projection 69 has the shape of a right-angled triangle when viewed from the side of the slider body 3, with the sloping face 71 facing outwards.

A ridge 33 projects from the central region 35 of the upper surface 25 of the upper blade 11, behind the base 37 of the crown 7 and extends towards the rear end 19. This ridge 33 is accommodated in an indent in the latch body 5, as described below, to facilitate alignment of the latch body 5 with the slider body 3.

Figure 4:
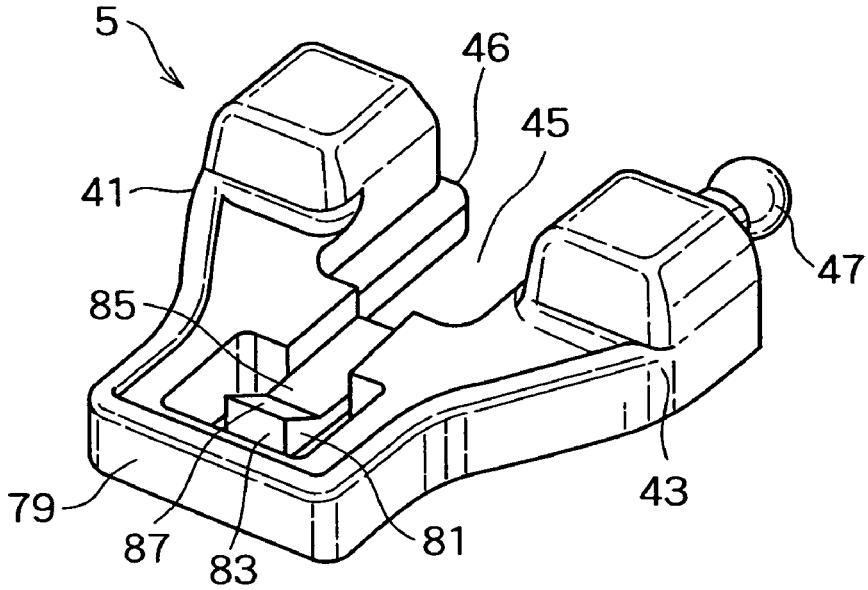
FIG. 4 is a perspective view of a latch body of the slider of FIG. 1.
Figure 5:
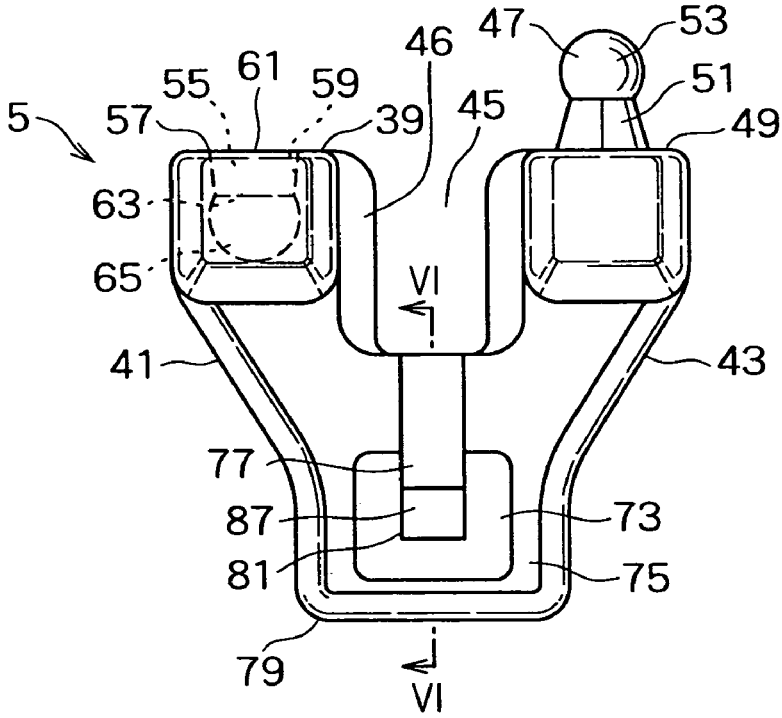
FIG. 5 is a plan view of the latch body of FIG. 4.

FIG. 4 is a perspective view of the latch body 5, which is shown in plan view in FIG. 5. The latch body 5 is generally Y-shaped and is made of plastic (e.g., acetal). The latch body 5 comprises the front end, the central portion 89 and the rear end 79 arranged in sequence from the front end to the rear end. At the front end 39 there are a pair of arms 41, 43, between which there is a gap 45. In the assembled slider 1, the two arms of 41, 43 straddle the base 37 of the crown 7, which is located in the gap 45.

The latch body 5 comprises latching means in the form of a protrusion 47 and a cooperating mouth 55. The protrusions 47 are formed as the first and the second latching members, and the mouths 55 are formed as the first and the second receiving portions. At least one of the protrusion 47 or the mouth 55 is elastic so that the protrusion 47 and the mouth 55 can come into engagement with each other through elastic deformation, and therefore, the latch bodies 5 are joined.

The protrusion 47 is formed outwards from the end face 49 of the second arm 43 and is generally ball ended, being comprised of a neck or throat portion 51 which extends from the end face 49, and a head 53 distal to the end face 49.

The mouth 55 is formed so as to extend inward from the end face 57 of the first arm 41 and is comprised of a neck or throat portion 59 which narrows from the opening 61 of the mouth 55 to form a ridge 63 with a cross section smaller than the cross section of the widest point of the head 53 of the protrusion 47. Beyond the ridge 63, the mouth 55 widens to form a hollow 65. The dimensions of the mouth 55 are such that when the slider 1 is latched to an identical slider, the protrusion 47 on each of the sliders 1 is accommodated in the opposed mouth 55 on the other slider 1. The maximum width (diameter) of the neck portion 59 of the mouth 55 is set to be less than the maximum width (diameter) of the head 53 of the protrusion 47, so that, when the head 53 is inserted into the neck portion 59, the head 53 comes into abutting and pressing engagement with the neck portion 59. As a result, the neck portion 59 is elastically deformed in the direction to become greater in width, while the head 53 is elastically deformed in the direction to become less in width. Both the neck portion 59 and the head 53 need not be elastic. At least one of the neck portion 59 or the head 53 may be elastic.

There is a C-shaped through aperture 73 formed around a tongue 77 in the rear end portion 75 of the latch body 5, in order to define the tongue 77 which projects towards the rear end 79 of the latch body 5. There is a ramp 81 on the distal end portion 83 of the upper face 85 of the tongue 77. The sloping face 87 of the ramp 81 faces inwards of the latch body 5, and slants upward rearward. The tongue 77 can be resiliently deflected downwards.

Figure 6:
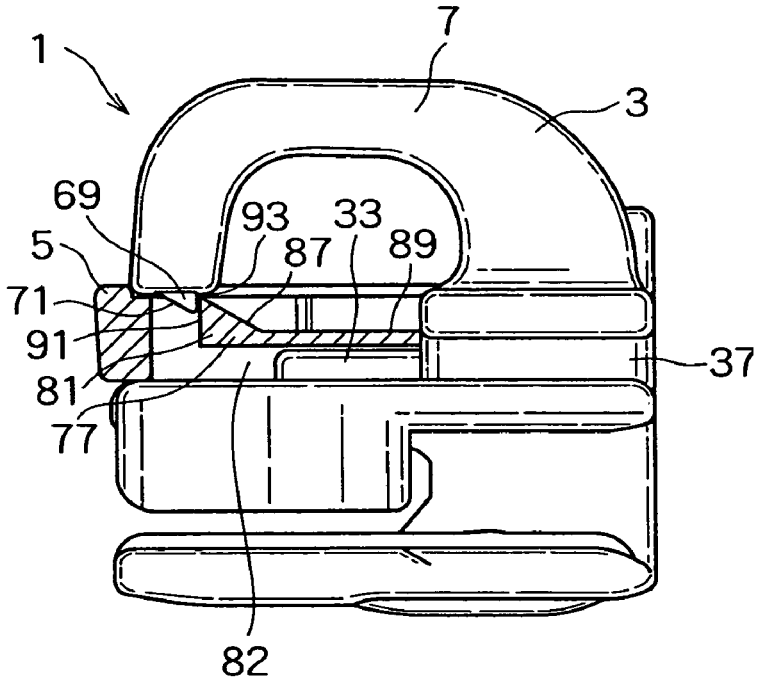
FIG. 6 is a side view of the slider of FIG. 1, showing a sectional view through the latch body.

FIG. 6 is a side view of an assembled slider 1, showing a sectional view of the latch body 5 along line VI-VI of FIG. 5. In the central portion 89 of the latch body 5, there is an indent 82 in the underside 89, to accommodate the ridge 33 of the slider body 3.

When the latch body 5 is inserted through the gap 29 of the slider body 3, the ridge 33 comes into engagement with the indent 82 in the underside 89 of the latch body 5. This limits the direction of movement of the latch body 5 so that the latch body 5 can move straight from the rear region 31 of the slider body 3 to the central region 35, and the latch body 5 can assume a proper posture.

To assemble the slider 1, a puller 9 is hooked onto the crown 7, the ridge 33 of the slider body 3 is aligned with the indent 82 of the latch body 5 in the longitudinal direction of the slider body 3 and the slider body 3 and the latch body 5 are pushed together. As these parts 3, 5 are pushed together, the sloping face 87 of the ramp 81 on the tongue 77 bears on the sloping face 71 of the projection 69 on the crown 7. The end portion 83 of the tongue 77 is deflected downwards as the sloping faces 71, 87 slide over each other, until the tongue 77 is pushed past the projection 69 on the crown 7. At this point the resiliently deflectable tongue 77 returns to its 'at rest' position or its original shape and the latch body 5 is mounted on the slider body 3. In the assembled slider 1, the end portion 83 of the tongue 77 and the projection 69 of the crown 7, that is, the respective abutting faces 91, 93 of the tongue 77 and the projection 69 act as cooperating locking means, preventing separation of the slider body 3 and the latch body 5 when the tongue 77 is at rest. The latch body 5 can be joined to the slider body 3 by inserting the central portion 89 of the latch body 5 through the gap 29 between the upper surface 25 of the upper blade 11 and the end face 67 of the free end 27 and thrusting it in the direction from the rear region 31 of the slider body 3 to the central region 35 thereof.

To separate the slider body 3 and the latch body 5, the end portion 83 of the tongue 77 is moved downwards (for example, by using a point or a tip of a stick), so that the abutting face 91 of the tongue 77 is moved clear of the abutting face 93 of the projection 69, to allow the abutting faces 91, 93 to pass each other. The latch body 5 is then moved away from the slider body 3, for example by being pushed with the point which is used to displace the end portion 83 of the tongue 77. The latch body 5 can be separated from the slider body 3 by passing the central portion 89 of the latch body 5 through the gap 29 between the upper surface 25 of the upper blade 11 and the end face 67 of the free end 27 and moving it to the direction from the central region 35 of the slider body 3 to the rear region 31 thereof. Since the latch body 5 is pulled off the slider body 3 with the abutting face 91 of the tongue 77 not facing the abutting face 93 of the sloping projection 69, these abutting faces 91, 93 will not come into abutting engagement with each other.

The ability of the tongue 77 to be resiliently deflected is a function of the material from which the latch body 5 is made and the dimensions of the tongue 77.

Figure 7:
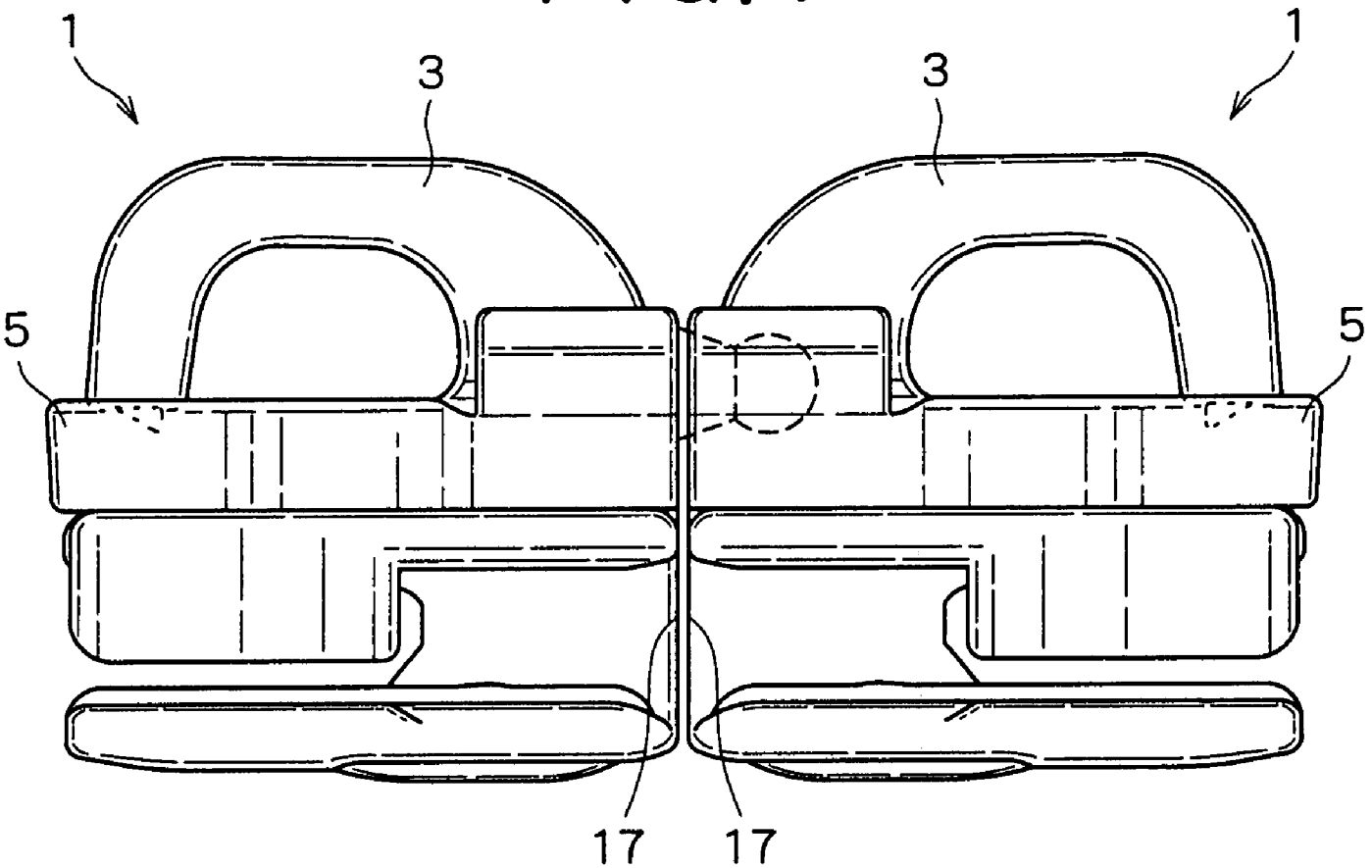
FIG. 7 is a side view of two latched sliders of FIG. 1.

FIG. 7 is a side view of a pair of mated sliders 1. When the latch bodies 5 mounted on both sliders 1 are engaged with each other, both sliders 1 are joined with their front ends 17 confronted to each other. Both sliders 1 come into locking engagement with each other without a gap between their front ends 17.

Figure 8:
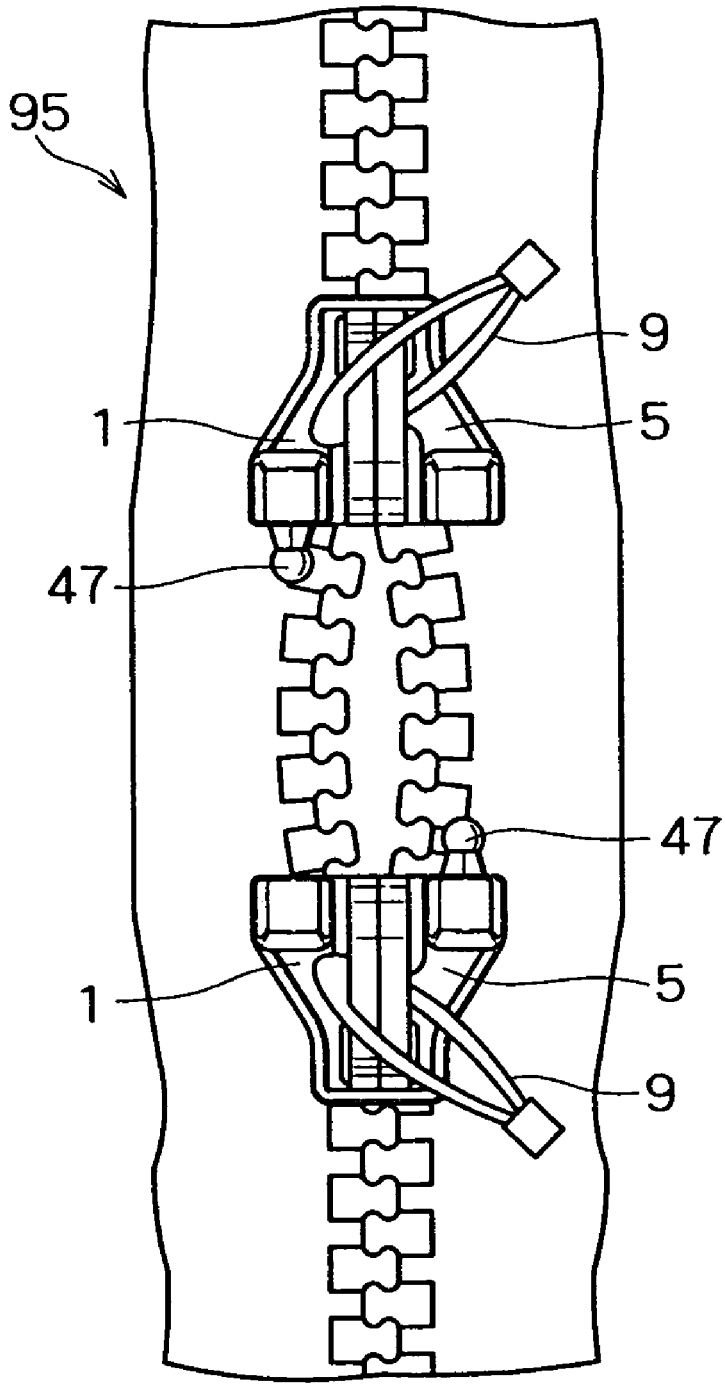
FIG. 8 is a plan view of a partially open slide fastener comprising two sliders embodying the invention.
Figure 9:
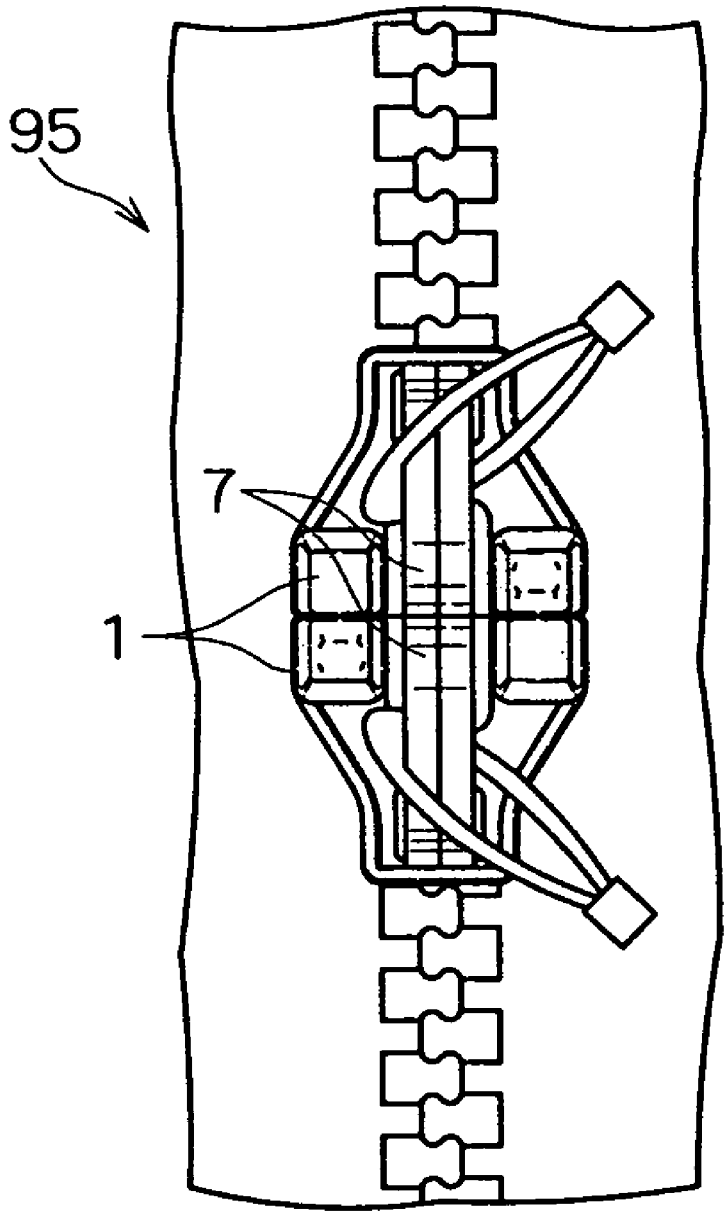
FIG. 9 is a plan view of the slide fastener of FIG. 8 when the sliders are latched together.

FIG. 8 shows a slide fastener 95 comprising two slidably mounted sliders 1 embodying the invention. As the sliders 1 are moved away from each other, the coupled fastener elements are uncoupled and the slide fastener 95 opens, and as the sliders 1 are moved towards each other, the uncoupled fastener elements are coupled and the slide fastener 95 closes. To close the slide fastener 95 and lock the sliders 1 together, the sliders 1 are moved towards each other so that the protrusion 47 on each slider 1 mates with the opposed mouth 55 on the other slider 1. The heads 53 of the protrusions 47 and/or the mouths 55 are resiliently deformed as the latch bodies 5 of the sliders 1 are pushed home. The sliders 1 are urged together either by using the pullers 9, or more preferably by using fingers to push the latch bodies 5 of the sliders 1. Pushing the sliders 1 together using fingers is easier than urging the sliders 1 together using the pullers 9, as the latch bodies 5 can be readily gripped and pushed directly towards each other, whereas if pullers 9 are used, each puller 9 obstructs the other, so that they will be pulled towards each other at an angle. Latching the sliders 1 by pushing the latch bodies 5 has the further advantage that this eliminates transmitting the pushing force through the abutting faces 91, 93. A slide fastener 95 having latched sliders 1 is shown in FIG. 9.

To separate the sliders 1, the pullers 9 are pulled away from each other. The pulling force is transmitted from the pullers 9 through the crowns 7 to the central portion 89 of the latch bodies 5 which abuts the base 37 of the crown 7. Again, there is no force transmitted through the abutting faces 91, 93 of the tongue 77 and the projection 69 of the crown 7.

Various modifications will be apparent to those in the art and it is desired to include all such modifications as fall within the scope of the accompanying claims. For example, the latch body 5 may be a male type, having a protrusion 47 on the end of each of the arms 41, 43. This latch body mates with a female latch body, having a mouth 55 in the end of each of the arms 41, 43. Alternatively, the latch body 5 may have a single protrusion 47 and no mouth 55, mating with a latch body 5 having a single mouth 55 and no protrusion 47. In a further embodiment, the upper surface 85 of the tongue 77 may be flat (i.e., there is no ramp 81 on the tongue 77), as long as the projection 69 on the end face 67 of the crown 7 projects downwards below the upper surface 85 of the tongue 77 in the assembled slider 1.

In yet a further embodiment the end face 67 of the free end 27 of the crown 7 may be flat (i.e., there is no projection 69 on the end face 67) and the ramp 81 on the tongue 77 projects upwards above the end face 27 of the crown 7 so that the abutting face 91 of the tongue 77 abuts the inner surface of the crown 7 in the assembled slider 1. In yet a further embodiment there may be no latching mechanism 47, 55 on the slider 1 for latching the slider 1 to a second slider 1; rather, the latch body 5 may merely be a removable body portion enabling effortless replacement of the puller 9.

In the specific embodiment described above, the abutting faces 91, 93 are perpendicular to the end face 67 of the free end 27 of the crown. In other embodiments the abutting faces 91, 93 may be sloped so that when they bear on each other they are brought closer together.

CONCLUSION, RAMIFICATIONS, AND SCOPE

In the thus assembled slider 1, the respective abutting faces 91, 93 of the tongue 77 and the projection 69 act as cooperating locking means, thus preventing separation of the slider body 3 and the latch body 5 when the tongue 77 is at rest, so that advantageously, the removable latch body can be firmly mounted on the slider body during normal use.

In order to separate the slider body 3 and the latch body 5, the end portion 83 of the tongue 77 is moved downwards (for example, by using a point), so that the abutting face 91 of the tongue 77 is moved clear of the abutting face 93 of the projection 69, to allow the abutting faces 91, 93 to pass each other. The latch body 5 is then moved away from the slider body 3, for example by being pushed with the point which is used to displace the end portion 83 of the tongue 77, so that replacement of the pull or the removable latch body can be advantageously replaced very easily or effortlessly.

Although the description above contains many specificities, these should not be construed as limiting the scope of the invention but as merely providing illustrating of some of the presently preferred embodiments of this invention.

Thus the scope of the invention should be determined by the appended claims and their legal equivalents, rather than by the examples given.

What is claimed is:

1. A slider for a slide fastener, the slider comprising:

a slider body which is slidable over elements of a slide fastener to engage and disengage the elements; and a latch body removably mounted on the slider body, the latch body comprising a latch member for latching the slider adjacent a second slider, wherein the latch body and the slider body comprise respective first and second cooperating lock members, the lock members preventing separation of the latch body from the slider body, the first lock member being resiliently movable to allow separation of the latch body from the slider body, wherein the latch member comprises a first latching member for latching with a first receiving portion of the second slider, and at least one of the first latching member or the first receiving portion is resiliently deformable.

2. A slider as claimed in claim 1, wherein the lock members comprise abutting faces, wherein the first lock member is movable to allow the abutting faces to pass each other to remove the latch body from the slider body.

3. A slider as claimed in claim 1, wherein the slider body comprises a crown for a puller attached at one end to the slider body, the crown having its base joined to the slider body and having its free end define a gap with the slider body, the second lock member being disposed on the free end of the crown.

4. A slider as claimed in claim 3, wherein the crown is attached to the slider body above a guide post of the slider body which partly defines an element-running path.

5. A slider as claimed in claim 1, wherein the latch member further comprises a second receiving portion for receiving a second latching member disposed on the second slider, at least one of the second latching member or the second receiving portion being resiliently deformable.

6. A slider as claimed in claim 1, wherein the slider body comprises a crown for a puller attached at one end to the slider body, the crown having its base joined to the slider body and having its free end define a gap with the slider body, and wherein when the latch body is assembled with the slider body, the latch body is accommodated in the gap.

7. A slider for a slide fastener, the slider comprising:

a slider body which is slidable over elements of a slide fastener to engage and disengage the elements; and a latch body removably mounted on the slider body, the latch body comprising a latch member for latching the slider to a cooperating slider, wherein:

the latch body and the slider body comprise respective first and second cooperating lock members, the lock members preventing separation of the latch body from the slider body, the first lock member being resiliently movable to allow separation of the latch body from the slider body, the lock members comprise abutting faces, wherein the first lock member is movable to allow the abutting faces to pass each other to remove the latch body from the slider body, and the abutting face of the first lock member is a face of a resiliently deflectable tongue.

8. A slider as claimed in claim 7, wherein the tongue has a sloping face on which the second lock member bears to deflect the tongue as the latch body is mounted on the slider body.

9. A slider as claimed in claim 7, wherein the second lock member comprises a sloping face on which the first lock member slides to deflect the tongue as the latch body is mounted on the slider body.

* * * * *